United States Patent [19]

Bright

[11] Patent Number: 4,632,384

[45] Date of Patent: Dec. 30, 1986

[54] HAND HELD EXERCISE DEVICE

[76] Inventor: George M. Bright, 525 Page Ave., NE., Atlanta, Ga. 30307

[21] Appl. No.: 830,253

[22] Filed: Feb. 18, 1986

Related U.S. Application Data

[63] Continuation of Ser. No. 516,589, Jul. 25, 1983, abandoned.

[51] Int. Cl.[4] ..... A63B 11/08

[52] U.S. Cl. ..... 272/68

[58] Field of Search ..... 272/67, 68, 135–139, 272/140–143, 93; 73/379

[56] References Cited

U.S. PATENT DOCUMENTS 938,348 10/1909 Stull ..... 272/68

3,570,849 3/1971 Ratchford ..... 272/68

*Primary Examiner*—Richard J. Apley

*Assistant Examiner*—S. R. Crow

*Attorney, Agent, or Firm*—Newton, Hopkins & Ormsby

[57] ABSTRACT

A self-contained, hand held and operated exerciser for the hand, wrist, arm, shoulder, chest and back muscles is disclosed. A pair of spaced parallel handles having freely rotatable gripping pads are biased apart by main torsion springs anchored to the handles near their ends. The main torsion springs are restrained by substantially rigid keepers and allow lateral displacement of the handles toward and away from each other over a limited distance during use of the exerciser. Supplemental torsion springs increasing the ability of the exerciser to resist forces exerted on it are conveniently installed and removed without the necessity for fastener elements or the use of tools.

17 Claims, 16 Drawing Figures

HAND HELD EXERCISE DEVICE

This is a continuation of co-pending application Ser. No. 516,589, filed on July 25, 1983, now abandoned.

BACKGROUND OF THE INVENTION

This invention relates to exercise devices and more particularly to a novel device for developing and strengthening the human finger, thumb, hand, wrist, arm, shoulder, chest and back muscles.

A principal object of this invention is to provide an exercise device especially designed to develop and strengthen the muscles used in gripping an object with the fingers and thumb curled around the object, such as a baseball bat handle, oar handle, pliers, and the like or the muscles used in gripping an object with the fingers curled around and the thumb extended somewhat along the object, such as a golf club handle or a racquet handle. Another principal object is to provide an exercise device having the same characteristics as the foregoing especially designed to develop and strengthen the wrist, arm, shoulder, chest, and back muscles used in performance of exercising motions consisting of compressing said device between the palm portions of the hands. Another principal object is to provide an exercise device having the same characteristics as the foregoing with its component parts especially designed to impart to said device structural unity and stability, whether said device is at rest, in motion, or being used or handled; to preclude the necessity of incorporating into the construction of said device any fastener, any fastening material or mechanism, any embedment of any component part, or any interference fit of component parts; and to permit repeated disassembly and reassembly of said device without the use of any tool, device, material, or non-human energy, and without alteration or modification of any component part.

Another principal object is to provide an exercise device having the same characteristics as the foregoing especially designed to have separate supplemental component parts which, when assembled onto said device, increase the ability of said device to resist the forces exerted on it by the user in performance of exercising motions. Another principal object is to provide an exercise device having the same characteristics as the foregoing with its component parts and its said separate supplemental component parts especially designed to impart to the assembly consisting of said device and said supplemental component parts structural unity and stability, whether said assembly is at rest, in motion, or being used or handled; to preclude the necessity of incorporating into the construction of said supplemental component parts or into said assembly any fastener, any fastening material or mechanism, any embedment of any component part, or any interference fit of any component parts; and to permit repeated disassembly and reassembly of said assembly and said device without the use of any tool, device, material, or nonhuman energy, and without alteration or modification of any component part.

Other objects are to provide hand size accommodation, provide simplicity and facility of use, and provide utility and versatility.

According to the present invention, the exercise device comprises a thumb handle and a fingers handle spaced apart therefrom and parallel thereto, each having near each end a radial cavity with said cavities spaced a lesser distance apart along the fingers handle than along the thumb handle. Each end portion of each handle carries a peripheral sleeve having a perforation aligned axially with and being a continuant of the cavity. The middle portion of each handle carries a loose circumambient peripheral pad having on one side a row of external serpentinely profiled nubs at spaced intervals therealong. The valleys between the nubs accept the digits, and each pad is rotatable about its axis shared with its handle to any desired position around the handle. The handles are connected by a pair of spaced apart main torsion springs, each of whose one divergent lever end extends through a sleeve perforation and into a thumb handle radial cavity, whose other divergent lever end extends through a sleeve perforation and into a fingers handle radial cavity, and whose loop portion is external the plane of the handles and slightly askew but essentially transverse the handles. Each main torsion spring carries a keeper about its midsection intermediate its lever end and its loop portion. An arcuate peripheral groove radial the handle axis and facing the other handle is provided in each thumb handle sleeve proximate the perforation and spaced therefrom equidistantly toward the midpoint of the handle and provided in each fingers handle sleeve proximate the perforation, spaced therefrom equidistantly toward the end of the handle, and situated opposite a thumb handle sleeve groove. At each end of the device the arcuate grooves accept and carry the arcuate divergent lever ends of a separate supplemental torsion spring, which when thusly assembled onto the handle sleeves lies transverse the handles and either straddled by or astride a main torsion spring. Preferably a main torsion spring straddles a separate supplemental torsion spring. Preferably each main torsion spring is uniplanar freestanding, and preferably the angle formed by its divergent lever ends is obtuse.

The objects of my invention will become apparent from the following description and accompanying drawings.

BRIEF DESCRIPTION OF DRAWING FIGURES

DETAILED DESCRIPTION

Figure 1:
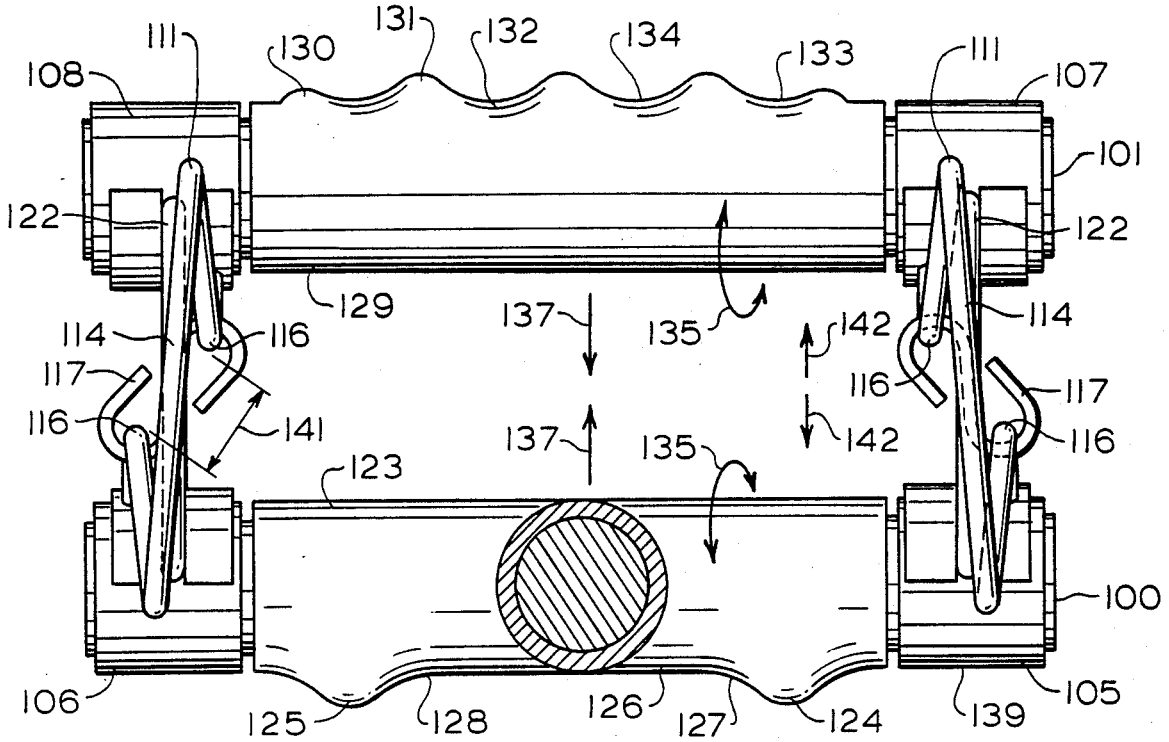
FIG. 1 is a front elevation view of my exercise device according to the preferred embodiment of the present invention.
Figure 2:
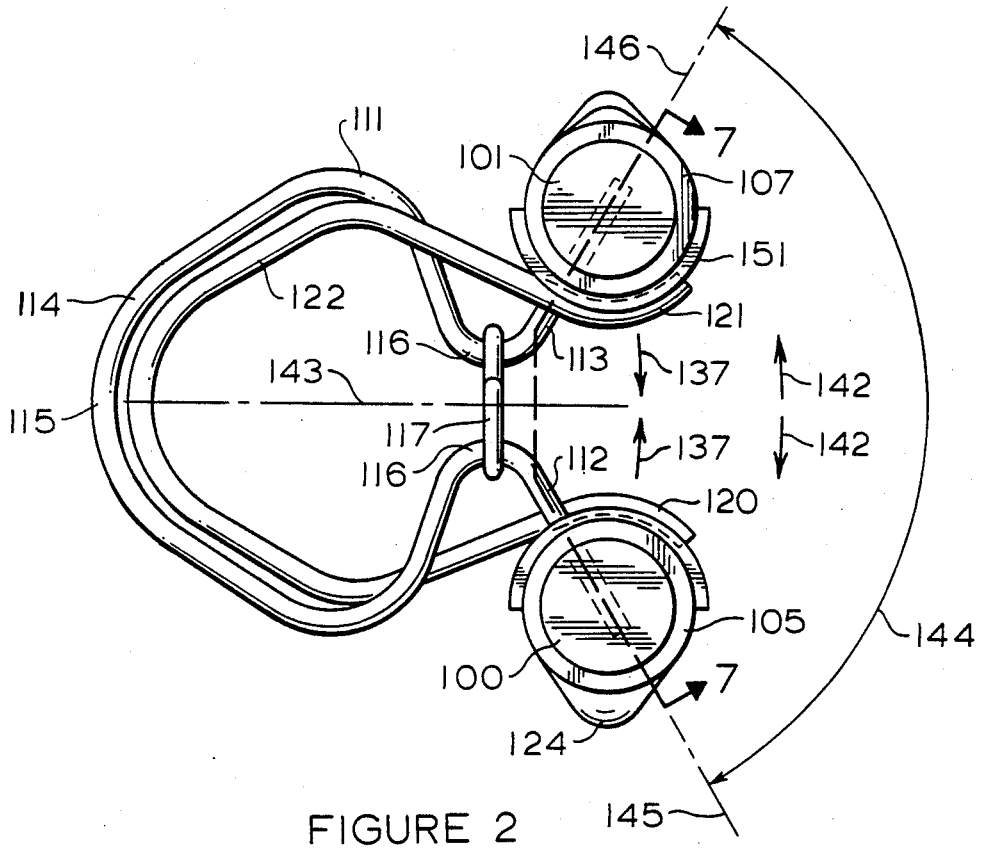
FIG. 2 is a right elevation view of the device shown in FIG. 1.
Figure 7:
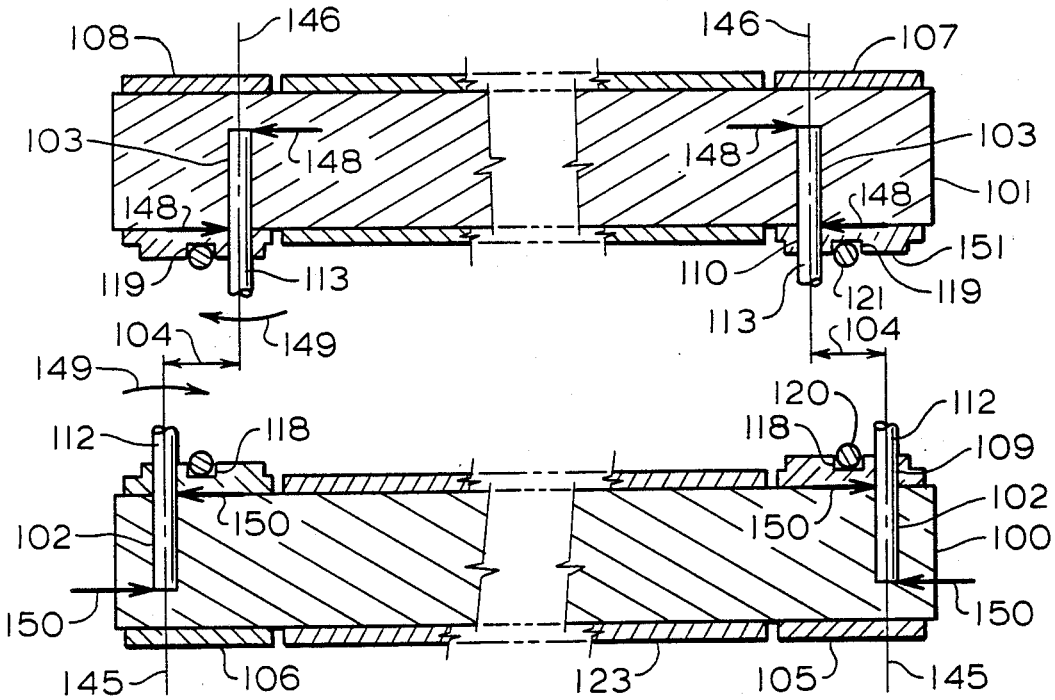
FIG. 7 is a section taken on line 7—7 of FIG. 2.

The exercise device, best depicted by FIGS. 1 and 2, comprises spaced apart handles 100 and 101 made of rigid material and having near each end a radial cavity, thumb handle 100 having radial cavities 102 and fingers handle 101 having radial cavities 103 spaced a lesser distance apart than cavities 102, as shown in FIG. 7. One half of the distance by which the cavity spacing along handle 100 exceeds the cavity spacing along handle 101 is represented in FIG. 7 by distance 104. Thumb handle 100 carries on one of its end portions a peripheral sleeve 105 and on its opposite end portion a peripheral sleeve 106, while fingers handle 101 carries on its corresponding end portions a peripheral sleeve 107 and a peripheral sleeve 108, said sleeves being preferably made of rigid material. Sleeves 105 and 106 each have a perforation 109 aligned with and being a continuant of a cavity 102, while sleeves 107 and 108 each have a perforation 110 aligned with and being a continuant of a cavity 103, as best shown in FIG. 7.

Figure 8:
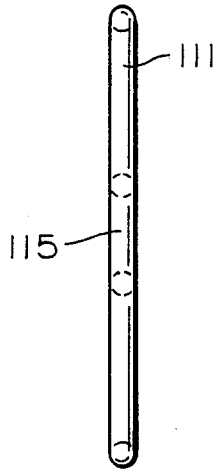
FIG. 8 is a front elevation view of the main torsion spring shown in FIG. 1, but depicting said spring freestanding.
Figure 9:
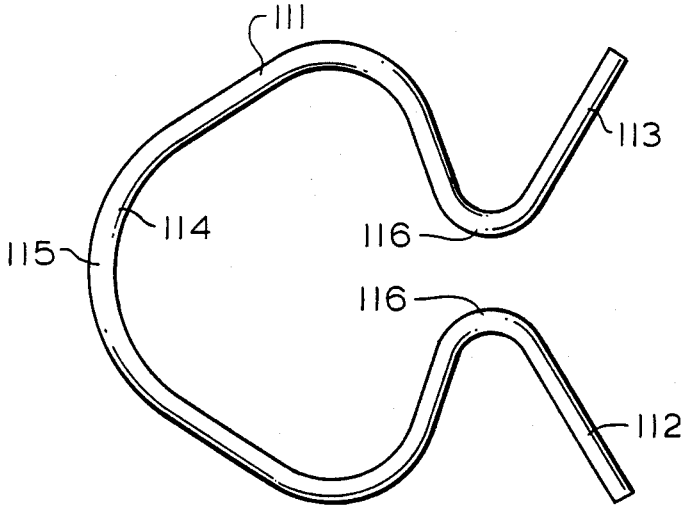
FIG. 9 is a right elevation view of the component part shown in FIG. 8.

Handles 100 and 101 are connected by a pair of spaced apart main torsion springs 111, each of whose one divergent lever end 112 extends through a perforation 109 and into a radial cavity 102 of handle 100 and each of whose other divergent lever end 113 extends through a perforation 110 and into a radial cavity 103 of handle 101, as best shown in FIG. 7, and whose loop portion 114 lies external the plane of handles 100 and 101, as best shown in FIG. 2, and slightly askew but essentially transverse said handles, as best shown in FIG. 1. Main torsion springs 111 preferably are each uniplanar freestanding, as shown in FIG. 8, and preferably the mechanical fit of freestanding lever ends 112 and 113 in radial cavities 102 and 103 of freestanding handles 100 and 101 is loose. As best shown in FIG. 9, main torsion spring 111 extends from its midpoint 115 curvilinearly in a convergent looping manner essentially as shown to its midsection portions 116, and thence in a divergent manner essentially as shown to the distal extremities of its straight divergent lever ends 112 and 113.

Figure 5:
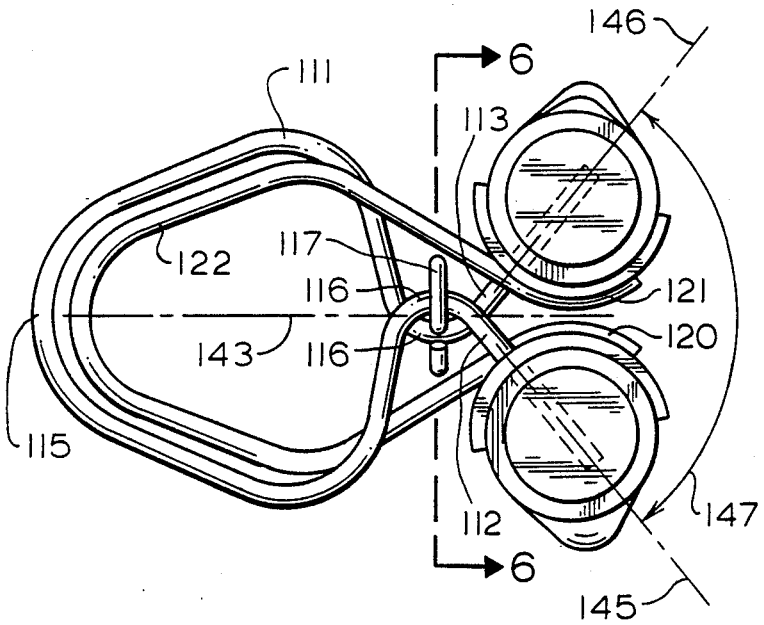
FIG. 5 is a view similar to FIG. 2, but showing the handles in another position.
Figure 6:
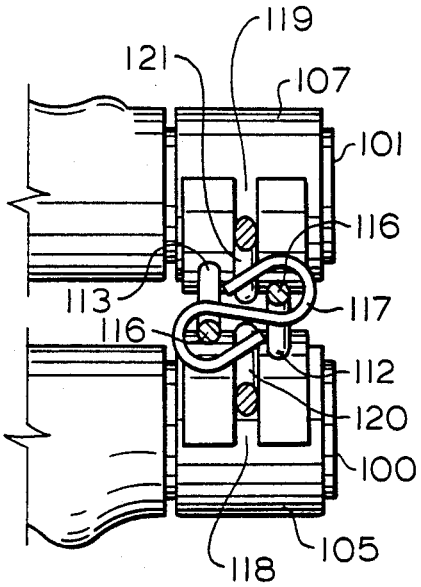
FIG. 6 is a section taken on line 6—6 of FIG. 5.

Each main torsion spring 111 carries about its midsection portions 116 a rigid uniplanar keeper 117, as best shown in FIGS. 1, 2, 5 and 6, whose purpose is to limit the maximum space separating handles 100 and 101 and the maximum space separating the midsection portions 116 of torsion spring 111, and whose configuration is not new, but whose gyrational application is unique. An arcuate peripheral groove 118, best shown in FIGS. 6 and 7, is provided in each sleeve 105 and 106, and an arcuate peripheral groove 119 opposing a groove 118 is provided in each sleeve 107 and 108. The arcuate divergent lever ends 120 and 121 of a separate supplemental torsion spring 122, best shown in FIG. 2, are accepted and carried by each opposed pair of peripheral grooves 118 and 119 of sleeves 105 and 107 and of sleeves 106 and 108, as best shown in FIGS. 6 and 7, and as shown in FIGS. 1 and 2, each supplemental torsion spring 122 when thusly assembled onto said sleeves lies transverse handles 100 and 101 and straddled by a main torsion spring 111. Preferably the configuration of spring 122 freestanding is essentially as depicted in FIGS. 1 and 2.

Figure 3:
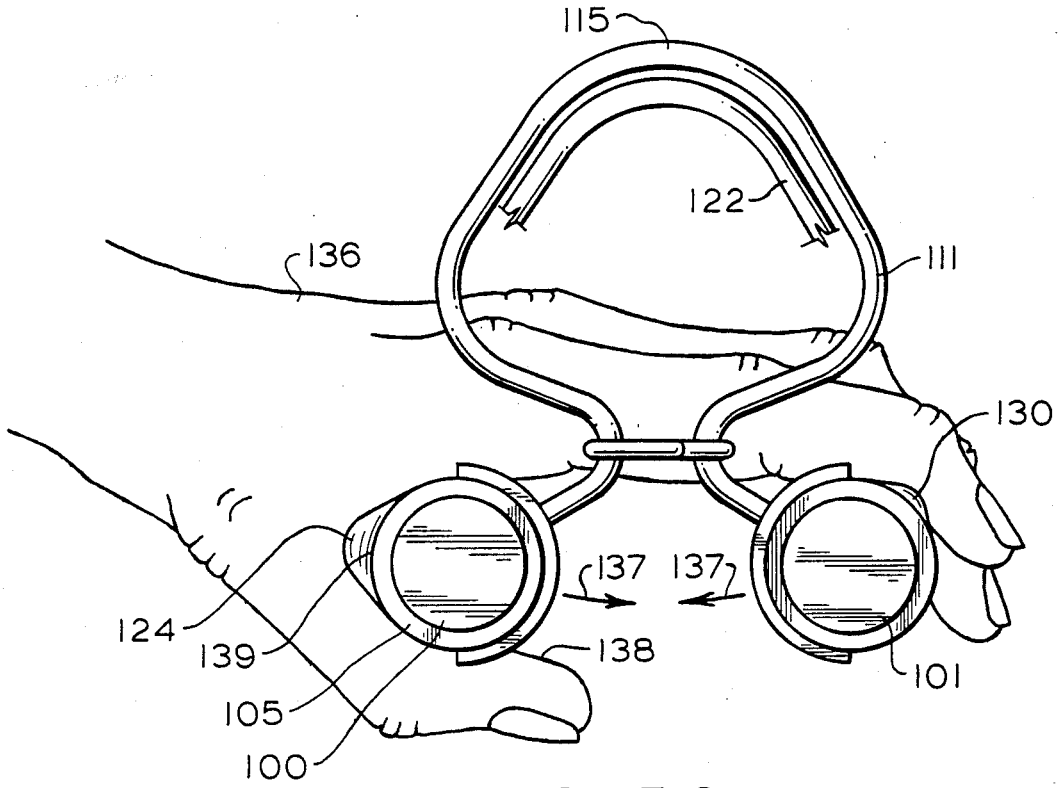
FIG. 3 is a right elevation view of the device shown in FIG. 1, but with parts of the supplemental torsion springs removed for clarity and the pads rotated to positions that accommodate the particular hand size, illustrating one manner in which the device is used.

As shown in FIG. 1, parts thereof being shown in revolved section, thumb handle 100 carries on its middle portion a loose peripheral thumb pad 123 having spaced apart serpentinely profiled thumb nubs 124 and 125 protruding therefrom along one side thereof and cooperating with periphery 126 of pad 123 to provide a left thumb valley 127 and a right thumb valley 128, and fingers handle 101 carries on its middle portion a loose periphery fingers pad 129 having serpentinely profiled finger nubs 130 and 131 protruding therefrom at spaced intervals along one side thereof and cooperating with periphery 132 of pad 129 to provide two each of finger valleys 133 and 134. Pads 123 and 129 preferably are made of resilient material and are circumambient their respective handles 100 and 101. Each said pad is rotatable about its handle to any desired position as indicated by the arrows 135. Said valleys can accept the digits of the human hand. As to operation, referring to FIG. 1 and in particular to FIGS. 3 and 4, in FIG. 3 the pads are rotated to positions at which the nubs accommodate the hand size, and in FIG. 4 the pads are rotated to positions that accommodate the grasping palms. FIG. 3 shows a human left hand 136 holding the device in the manner prescribed by reference made hereinbefore to valleys 127, 133 and 134. As the handles are brought toward each other in the directions of arrows 137 by the convergent closing motion of the fingers and thumb, handles 100 and 101 traverse an arcuate path essentially coinciding with arrows 137 and having a center coinciding with the midpoint 115 of spring 111. The convergent movement of the handles applies bending moments acting on and causing torsion springs 111 and 122 progressively to coil and ultimately to assume configurations essentially as shown in FIG. 5. The torsion springs resist said bending moments, and the finger, hand, wrist, and arm muscles acting to overcome the resistance are thusly provided with developing and strengthening exercise. The handhold depicted in FIG. 3 can be varied by pivoting the left thumb and shifting ball 138 thereof onto selected portion 139 of sleeve 105, to develop and strengthen the muscles used in gripping an object such as a golf club handle. Either or both springs 122 can be disengaged from the sleeves and removed from the device to provide a different total spring strength.

Figure 4:
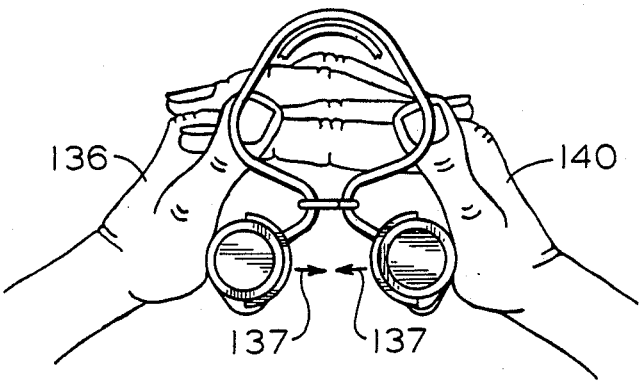
FIG. 4 is a view similar to FIG. 3, but showing the pads rotated to positions that accommodate the particular grasp, illustrating another manner in which the device is used.

In FIG. 4 there are shown the left hand 136 and the right hand 140 of a human being operating the device, the convergent closing motion of the palms being employed and the hand, wrist, arm, shoulder, chest and back muscles engaged being provided with developing and strengthening exercise.

In reference to FIGS. 1, 2, 5 and 6, in FIG. 1 the numeral 141 indicates the distance separating the midsection portions 116 of a main torsion spring 111. In FIGS. 1 and 2 there is shown the rigid uniplanar keeper 117 limiting the divergent movement of the portions 116 of spring 111 in the directions of the arrows 142. In FIG. 2 there is shown the axis 143, which is shared by springs 111 and 122 and keeper 117. As handles 100 and 101 are moved in the directions of arrows 137 from positions occupied in FIGS. 1 and 2 into positions occupied in FIGS. 5 and 6, spring midsection portions 116 likewise are moved, progressively reducing the distance 141 and transporting keeper 117, thereby causing said keeper to gyrate essentially on axis 143 from its position occupied in FIG. 1 into its position occupied in FIG. 6.

As to mechanical and structural design, referring to FIGS. 2, 3, 4, 5 and 7, in FIG. 2 there is shown the obtuse central angle 144 formed by the center lines 145 and 146 of straight lever ends 112 and 113. The forces applied by the user in FIG. 3 or 4 to move the handles 100 and 101 in the directions of arrows 137 progressively to their ultimately closed positions, in which the center lines 145 and 146 form the central angle 147 shown in FIG. 5, have parallel to said center lines vector components which perforce act to impart structural unity to the assembly of lever ends 112 and 113 and their handle cavities 102 and 103 shown in FIG. 7.

As to further mechanical and structural design, referring to FIGS. 1 and 7, FIG. 7 shows that straight lever ends 112 and 113 are essentially perpendicular to handles 100 and 101. A plane containing center line 145 and perpendicular to handle 100 would be spaced a distance 104 from a plane containing center line 146 and perpendicular to handle 101, the loop portion 114 of spring 111 lying askew said handles as shown in FIG. 1. Spring 111, considered as a uniplanar cantilever beam having its end 112 fixed at handle 100 and its end 113 deflected the distance 104 while not free to rotate, is equivalent to a cantilever beam deflected by the couple 148 applied to its nonrotating cantilevered end 113. The couple 148 is balanced by the moment 149 internal the spring 111 and by the external couple 150 at end 112, said couples and said moment progressively increasing in magnitude as said handles are moved toward each other. Couples 148 and 150 cooperate with the coefficients of friction between the handles and the lever ends 113 and 112 to impart structural unity and stability to the device as a result of the frictional forces produced.

As to still further mechanical design, referring to FIGS. 1 and 2, each supplemental torsion spring 122 lies perpendicular to the plane of the handles 100 and 101 and is straddled by a main torsion spring 111, which perforce restricts the spring 122 to its essentially perpendicular position. Referring to FIGS. 2 and 7, removal of spring 122 from the device is quickly and easily accomplished by first moving the arcuate divergent lever end 121 in the direction of the arrow 137 shown adjacent thereto in FIG. 2 a distance sufficient to clear the plateau 151 of sleeve 107 shown in FIGS. 2 and 7 and then rotating spring 122 essentially about the axis 143 and away from spring 111.

Figure 10:
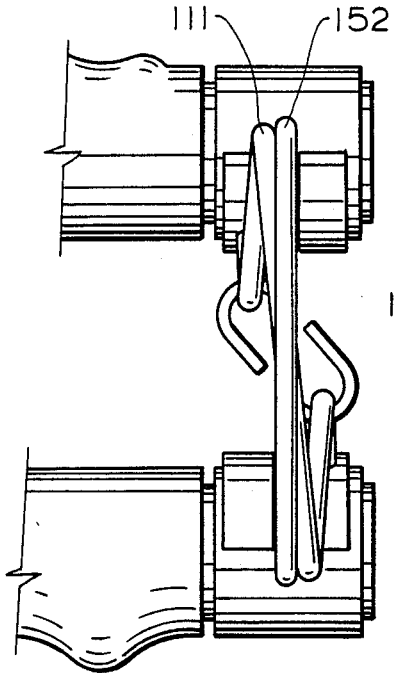
FIG. 10 is a partial front elevation view of a modified form of my exercise device.
Figure 11:
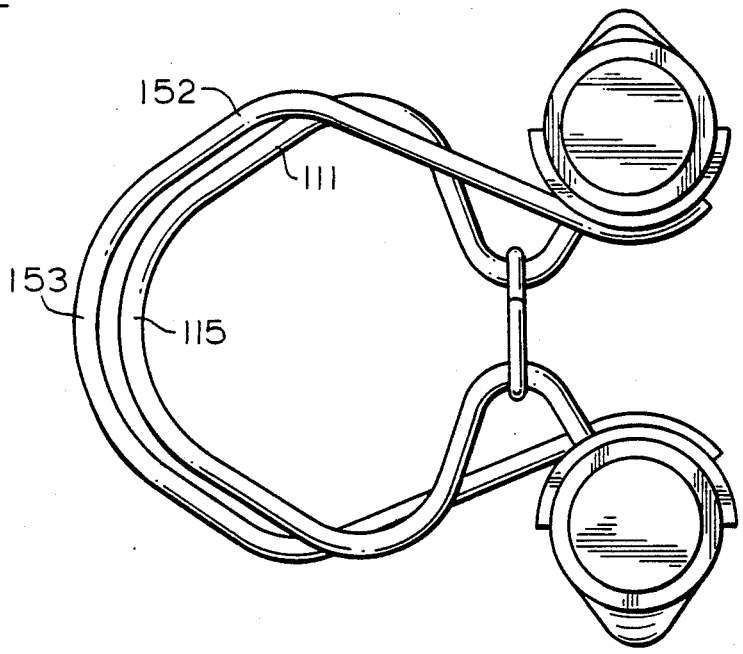
FIG. 11 is a right elevation view of the device shown in FIG. 10.

With reference to FIGS. 10 and 11, there is shown a modification of the device comprising a pair of straddling separate supplemental torsion springs 152 and the aforesaid handles 100 and 101, sleeves 105 through 108, main torsion springs 111, keepers 117, and pads 123 and 129. Straddling each spring 111 is a spring 152 with its midpoint 153 lying external the space occupied by spring 111, and this modification is otherwise identical in all respects to the device shown in FIGS. 1 and 2.

Figure 12:
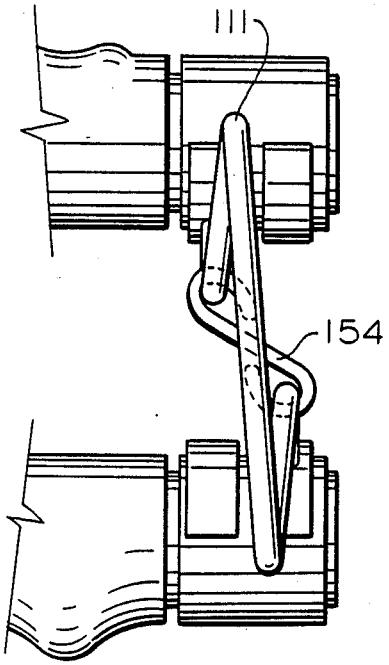
FIG. 12 is a partial front elevation view of another modified form of my exercise device, but with the supplemental torsion springs removed for clarity.
Figure 13:
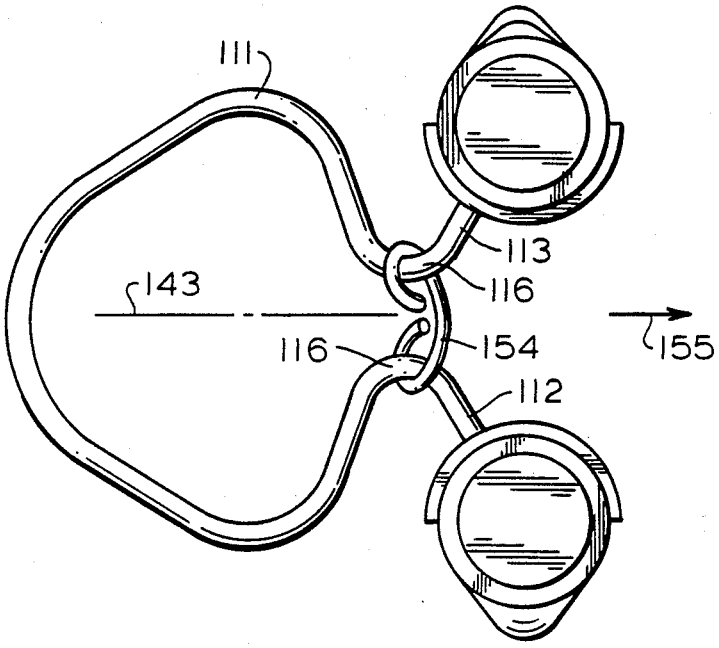
FIG. 13 is a right elevation view of the device shown in FIG. 12.
Figure 14:
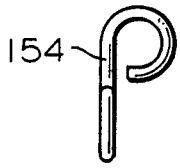
FIG. 14 is a front elevation view of a component part of the modification shown in FIG. 13.
Figure 15:
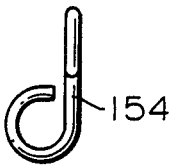
FIG. 15 is a right elevation view of the component part shown in FIG. 14.
Figure 16:
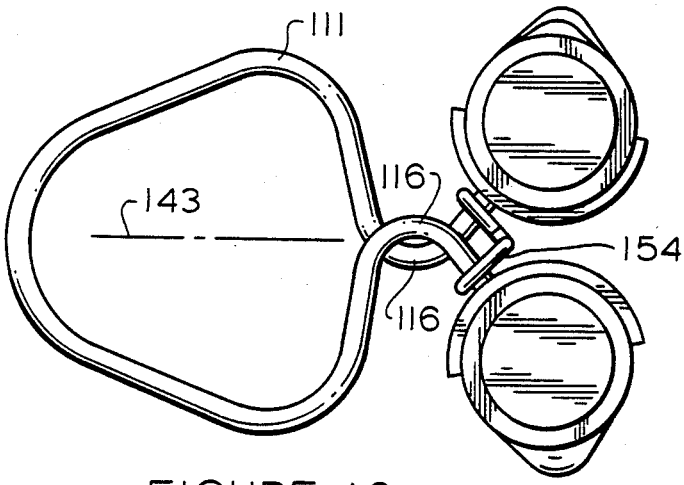
FIG. 16 is a view similar to FIG. 13, but showing the handles in a different position.

With reference to FIGS. 12 and 13, there is shown another modification of the device comprising a pair of non-gyrating rigid keepers 154 and the aforesaid handles, sleeves, main torsion springs, and pads, it being understood that the aforesaid supplemental torsion springs 122 or 152 can be assembled onto said sleeves to provide additional spring strength. The keeper shown in FIGS. 12 through 16 is the right-hand version of keeper 154, the left-hand version being the mirror image thereof employed at the opposite end of the device. In particular reference to FIGS. 13 and 16, as the handles are moved from positions occupied in FIG. 13 into positions occupied in FIG. 16, spring midsection portions 116 and lever ends 112 and 113 similarly are moved and transport the keeper 154 in the direction of the arrow 155 into its position occupied in FIG. 16 without causing or allowing said keeper to gyrate about the axis 143, and this modification is otherwise identical in all respects to either the device shown in FIGS. 1 and 2 or the modification shown in FIGS. 10 and 11.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. An exerciser comprising a pair of spaced opposing parallel handles of a size to allow gripping by a hand of the user of the exercier, said handles being provided at their sides with radially extending openings inwardly adjacent to the ends of said handles, said openings projecting from the surface of said handles inwardly in radial directions toward the axes of said handles, a pair of torsion springs including loops projecting beyond corresponding sides of the handles in planes substantially normal to the handle axes, said loops having intermediate portions protruding toward each other, and further including outwardly divergent end portions received and anchored within said radially extending openings, the end portions of each of said tension springs protruding radially from said handles inwardly toward each other add being connected by their intermost portions to said intermediate portions, and keeper elements respectively connected between the intermediate portions of the respective torsion springs for restraining expansion of the torsion springs in a direction causing separation of the handles and allowing limited lateral relative movement of the handles away from each other during use of the exerciser.

2. An exerciser as defined in claim 1, and freely rotatably gripping sleeves on the handles and between said torsion spring.

3. An exerciser comprising a pair of spaced opposing handles of a size to allow gripping by a hand of the user of the exerciser, a pair of torsion springs including loops projecting beyond corresponding sides of the handles in planes substantially normal to the handle axes and further including divergent end portions received within and anchored by radial openings formed in the handles near their opposite ends, and the handles having arcuate groove seats formed therein near their ends in opposing relationship, and a pair of readily installable and removable auxiliary torsion springs including loops lying substantially adjacent to the loops of the first named torsion springs and having arcuate end portions engageable within the groove seats, the auxiliary torsion springs being biased to cause separation of said handles.

4. An exerciser as defined in claim 3, and freely rotatable gripping sleeves on the handles between the first-named and auxiliary torsion springs.

5. An exerciser as defined in claim 4, and the gripping sleeves being formed of resilient material and being profiled to form finger and thumb rest portions thereon.

6. An exerciser as defined in claim 1, and the keeper elements comprising substantially S-hooks and being substantially rigid and having their opposite ends engaged with opposing midsection loops of the torsion springs located between the divergent end portions and the first-named loops of the torsion springs, and the midsection loops forming on the torsion springs constrictions between the first-named loops and divergent end portions.

7. An exerciser as defined in claim 1, and said keeper elements comprising elements which include a pair of loops connected together substantially in right angular relationship.

8. An exerciser as defined in claim 7, and the right angular loops of said keepers being slidably engaged with opposing constrictive midsection loops on the torsion springs between said divergent end portions and first-named loops.

9. An exerciser as defined in claim 3, and said auxiliary torsion springs being disposed substantially in straddling relationship to the first-named torsion springs on the exerciser and projecting more distantiy beyond said corresponding sides of the handles than the first-named torsion springs.

10. An exerciser as defined in claim 1, and pairs of fixed sleeves on opposite end portions of the handles and having radial openings in registration with said radial openings of the handles and receiving said divergent end portions.

11. An exerciser comprising a pair of spaced opposing parallel handles of a size to allow gripping by a hand of the user of the exerciser, a pair of torsion springs including loops projecting beyond corresponding sides of the handles in planes substantially normal to the handle axes and further including divergent end portions received within and anchored by radial openings formed in the handles near their opposite ends, and keeper elements connected with intermediate portions of the torsion springs and restraining expansion of the torsion springs in a direction causing separation of the handles and allowing limited lateral relative movement of the handles away from each other during use of the exerciser; pairs of fixed sleeves on opposite end portions of the handles and having radial openings in registration with said radial openings of the handles and receiving said divergent end portions; and said last-named sleeves having arcuate grooves formed at least in their peripheral portions between the opposing handles, and readily removable auxiliary torsion springs having arcuate end portions adapted for seating in said arcuate grooves.

12. An exerciser comprising a pair of spaced opposing parallel handles of a size and shape to allow gripping by a hand of a user of the exerciser, at least a pair of expansive torsion springs interconnecting the handles near their opposite ends and exerting forces on the handles tending to separate the handles, the handles having divergent radially extending openings near their opposite ends, the torsion springs lying substantially in planes normal to the axes of the handles and projecting substantially beyond corresponding sides of the handles in such planes, the torsion springs each having a main relatively large loop body portion remote from the handles and having outwardly diverging straight end portions disposed at obtuse angles to each other and protruding into said radial openings of the handles, the torsion springs having opposing midsection loops between the divergent end portions and main loop body portions and defining constricted midsections on the torsion springs, and keepers interconnecting the midsection loops and being connected therewith in a manner to enable limited movement of the handles away from each other during the operation of the exerciser.

13. An exerciser as defined in claim 12, and the keepers comprising S-hooks.

14. An exerciser as defined in claim 12, and rotational gripping sleeves on the handles between the torsion springs.

15. An exerciser as defined in claim 12, and a pair of auxiliary torsion springs having generally the shapes of said expansive torsion springs and being releasably engaged with the handles near the expansive torsion springs.

16. An exerciser comprising a pair of spaced opposing parallel handles of a size to allow gripping by a hand of a user of the exerciser, said handles being provided at their sides with openings extending radially and inwardly and situated adjacent to the ends of said handles, said openings extending from the surface of said handles inwardly in radial directions toward the axes of said handles, a pair of torsion springs including loops projecting beyond corresponding sides of the handles in planes substantially normal to the handle axes, said loops having intermediate portions converging toward each other and having means connected thereto for restraining expansion of said torsion springs, and further including outwardly divergent end portions received and anchored within said radially extending opening of said handles.

17. The exerciser device defined in claim 16 wherein said springs are lengths of rods respectively disposed in spaced parallel planes, said planes being perpendicular to the axes of said handle, each of said springs being a unitary length of rod bent to form a loop haviAg a middle portion diverging outwardly above said converging intermediate portion.

* * * * *